US007794586B2

(12) United States Patent
Varadaraj et al.

(10) Patent No.: US 7,794,586 B2
(45) Date of Patent: Sep. 14, 2010

(54) VISCOELASTIC UPGRADING OF HEAVY OIL BY ALTERING ITS ELASTIC MODULUS

(75) Inventors: Ramesh Varadaraj, Flemington, NJ (US); Michael Siskin, Randolph, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 909 days.

(21) Appl. No.: 11/127,824

(22) Filed: May 12, 2005

(65) Prior Publication Data

US 2005/0258075 A1 Nov. 24, 2005

Related U.S. Application Data

(60) Provisional application No. 60/571,349, filed on May 14, 2004.

(51) Int. Cl.
*C10G 9/00* (2006.01)

(52) U.S. Cl. ..... 208/131; 208/13; 208/50; 208/132; 208/370

(58) Field of Classification Search ..... 208/13, 208/50, 131, 132, 370
See application file for complete search history.

(56) References Cited

U.S. PATENT DOCUMENTS

| | | | | |
|---|---|---|---|---|
| 2,626,207 A | | 1/1953 | Wies et al. | |
| 2,843,530 A | | 7/1958 | Langer, Jr., et al. | |
| 3,558,474 A | | 1/1971 | Gleim et al. | 208/108 |
| 3,617,514 A | | 11/1971 | Marlar | 208/131 |
| 3,619,413 A | * | 11/1971 | Folkins | 208/131 |
| 3,684,697 A | | 8/1972 | Gamson | 208/131 |
| 3,707,459 A | | 12/1972 | Mason et al. | 208/76 |
| 3,769,200 A | | 10/1973 | Folkins | 208/53 |
| 3,852,047 A | | 12/1974 | Schlinger et al. | 44/24 |
| 4,140,623 A | | 2/1979 | Sooter et al. | 208/131 |
| 4,226,805 A | | 10/1980 | Bauer | |
| 4,280,559 A | * | 7/1981 | Best | 166/303 |
| 4,298,455 A | | 11/1981 | Huang | 208/48 AA |
| 4,399,024 A | | 8/1983 | Fukui et al. | 208/131 |
| 4,411,770 A | | 10/1983 | Chen et al. | 208/111 |
| 4,430,197 A | | 2/1984 | Poynor et al. | 208/56 |
| 4,440,625 A | | 4/1984 | Go et al. | 208/48 AA |

(Continued)

FOREIGN PATENT DOCUMENTS

EP 0031697 7/1981

(Continued)

OTHER PUBLICATIONS

Kelley, J.J., "Applied artificial intelligence for delayed coking," Foster Wheeler USA Corp., Houston, TX, reprinted from Hydrocarbon Processing magazine, Nov. 2000, pp. 144-A-144-J.

(Continued)

*Primary Examiner*—Glenn Caldarola
*Assistant Examiner*—Prem C. Singh
(74) *Attorney, Agent, or Firm*—Bruce M. Bordelon

(57) ABSTRACT

A method for upgrading the viscoelastic properties of a heavy oil by altering its elastic modulus. An effective amount of one or more elastic modulus lowering agents are used, wherein preferred elastic modulus lowering agents include mineral and organic acids and bases, preferably strong bases, such as hydroxides of metals selected from the alkali and alkaline-earth metals.

10 Claims, 3 Drawing Sheets

U.S. PATENT DOCUMENTS

| | | | | |
|---|---|---|---|---|
| 4,455,219 | A | 6/1984 | Janssen et al. | 208/131 |
| 4,478,729 | A | 10/1984 | Hunt et al. | |
| 4,518,487 | A | 5/1985 | Graf et al. | 208/131 |
| 4,529,501 | A | 7/1985 | George | 208/127 |
| 4,549,934 | A | 10/1985 | Graf et al. | 196/98 |
| 4,592,830 | A | 6/1986 | Howell et al. | 208/94 |
| 4,612,109 | A | 9/1986 | Dillon et al. | 208/131 |
| 4,615,791 | A | 10/1986 | Choi et al. | |
| 4,616,308 | A | 10/1986 | Morshedi et al. | 364/159 |
| 4,619,756 | A | 10/1986 | Dickakian | |
| 4,659,453 | A | 4/1987 | Kukes et al. | |
| 4,670,165 | A * | 6/1987 | Black et al. | 507/224 |
| 4,847,018 | A | 7/1989 | Koepke et al. | |
| 4,927,561 | A | 5/1990 | Forester | 252/389.22 |
| 4,966,679 | A | 10/1990 | Kubo et al. | |
| 5,160,602 | A | 11/1992 | Becraft et al. | 208/131 |
| 5,248,410 | A | 9/1993 | Clausen et al. | 208/131 |
| 5,258,115 | A | 11/1993 | Heck et al. | 208/131 |
| 5,296,130 | A | 3/1994 | Kriz et al. | |
| 5,460,714 | A | 10/1995 | Fixari et al. | 208/112 |
| 5,645,711 | A | 7/1997 | Hraban et al. | 208/131 |
| 5,650,072 | A | 7/1997 | McClain et al. | |
| 5,820,750 | A | 10/1998 | Blum et al. | 208/263 |
| 5,853,565 | A | 12/1998 | Cayton | 208/48 AA |
| 6,048,904 | A | 4/2000 | Wiehe et al. | 516/20 |
| 6,168,709 | B1 | 1/2001 | Etter | 208/131 |
| 6,193,875 | B1 | 2/2001 | Pereira et al. | 208/130 |
| 6,264,829 | B1 | 7/2001 | Antalffy et al. | 208/131 |
| 6,387,840 | B1 | 5/2002 | Salazar et al. | 502/170 |
| 6,611,735 | B1 | 8/2003 | Henly et al. | 700/266 |
| 6,660,131 | B2 | 12/2003 | Lah | 202/245 |
| 2002/0033265 | A1 | 3/2002 | Varadaraj | 166/303 |
| 2002/0125174 | A1 | 9/2002 | Varadaraj | 208/263 |
| 2002/0161059 | A1 | 10/2002 | Varadaraj et al. | 516/113 |
| 2003/0127314 | A1 | 7/2003 | Bell et al. | 202/262 |
| 2003/0132139 | A1 | 7/2003 | Varadaraj | 208/265 |
| 2003/0191194 | A1 | 10/2003 | Varadaraj | 516/52 |
| 2004/0035749 | A1 | 2/2004 | Khan et al. | 208/106 |

FOREIGN PATENT DOCUMENTS

| | | |
|---|---|---|
| EP | 175511 | 6/1988 |
| EP | 0839782 A1 | 5/1998 |
| GB | 1218117 | 1/1971 |
| WO | 95/14069 | 5/1995 |
| WO | 99/64540 | 12/1999 |
| WO | 03042330 | 5/2003 |
| WO | 03048271 | 6/2003 |
| WO | 2004/038316 | 5/2004 |
| WO | 2004/104139 | 12/2004 |

OTHER PUBLICATIONS

Gentzis, Thomas; Rahimi, Pavis; Malhotra, Ripudaman; Hirschon, Albert S., "The effect of carbon additives on the mesophase induction period of Athabasca bitumen," Fuel Processing Technology 69 (2001) pp. 191-203.

Dabkowski, M.J.; Shih, S.S.; Albinson, K.R., "Upgrading of petroleum residue with dispersed additives," Mobil Research & Development Corporation, Paulsboro, NJ. Presented as Paper 19E at the 1990 AIChE National Meeting.

Giavarini, C.; Mastrofini, D.; Scarsella, M., "Macrostructure and Rheological Properties of Chemically Modified Residues and Bitumens," Energy & Fuels 2000, 14, pp. 495-502.

Lakatos-Szabo, J.; Lakatos, I., "Effect of sodium hydroxide on interfacial rheological properties of oil-water systems," Research Institute of Applied Chemistry, University of Miskolc, Hungary, accepted Aug. 24, 1998, Elsevier Science B.V., Physicochemical and Engineering Aspects 149 (1999) pp. 507-513.

Ellis, Paul J.; Paul, Christopher A., "Tutorial: Delayed Coking Fundamentals," Great Lakes Carbon Corporation, Port Arthur, TX, copyright 1998 (unpublished). Presented at the AIChE 1998 Spring National Meeting, New Orleans, LA, Mar. 8-12, 1998.

* cited by examiner

VISCOELASTIC UPGRADING OF HEAVY OIL BY ALTERING ITS ELASTIC MODULUS

CROSS-REFERENCE TO RELATED APPLICATION

This application claims benefit of U.S. Provisional Patent Application Ser. No. 60/571,349 filed May 14, 2004.

FIELD OF THE INVENTION

The present invention relates to a method for upgrading the viscoelastic properties of a heavy oil by altering its elastic modulus. An effective amount of one or more elastic modulus lowering agents are used, wherein preferred elastic modulus lowering agents include mineral and organic acids and bases, preferably strong bases, such as hydroxides of metals selected from the alkali and alkaline-earth metals.

BACKGROUND OF THE INVENTION

The characteristics of petroleum crudes is typically dependent on the geographical location of the reservoir and its geological origin and extent of biodegradation. While it is more desirable to produce lighter, lower viscous, low acidity sweet crudes, such crudes are becoming harder and harder to find. Many crudes on the market today are heavy and sour crudes having high acidity and high viscosity and have poor flow properties making them difficult to recover from underground reservoirs, difficult to transport via pipeline. Also, in the refinery, the residuum resulting from such crudes suffers from the same flow problems, as well as having poor injection properties that can plug process equipment or render less effective the processing of such crudes.

The conventional approach to crude upgrading has focused on viscosity reduction. Viscosity reduction is important in the production, transportation and refining operations of crude oil. Transporters and refiners of heavy crude oil have developed different techniques to reduce the viscosity of heavy crude oils to improve its pumpability. Commonly practiced methods include diluting the crude oil with gas condensate and emulsification with caustic and water. Thermally treating crude oil to reduce its viscosity is also well known in the art. Thermal techniques for visbreaking and hydro-visbreaking (visbreaking with hydrogen addition) are practiced commercially. The prior art in the area of thermal treatment or additive enhanced visbreaking of hydrocarbons teach methods for improving the quality, or reducing the viscosity, of crude oils, crude oil distillates or residuum by several different methods. For example, several references teach the use of additives such as the use of free radical initiators (U.S. Pat. No. 4,298,455), thiol compounds and aromatic hydrogen donors (EP 175511), free radical acceptors (U.S. Pat. No. 3,707,459), and hydrogen donor solvent (U.S. Pat. No. 4,592,830). Other art teaches the use of specific catalysts such as low acidity zeolite catalysts (U.S. Pat. No. 4,411,770) and molybdenum catalysts, ammonium sulfide and water (U.S. Pat. No. 4,659,453). Other references teach upgrading of petroleum resids and heavy oils (Murray R. Gray, Marcel Dekker, 1994, pp. 239-243) and thermal decomposition of naphthenic acids (U.S. Pat. No. 5,820,750).

It is taught in U.S. Patent Application Number 20040035749 that the flow properties of crude petroleum having an API gravity varying from about 6 to 12 are improved by heating the crude petroleum to a temperature of about 35° C. to 200° C. and, in the presence of a suitable viscosity reducing additive, shearing the heated crude petroleum with a high shearing force sufficient to reduce the viscosity of the crude petroleum to a range of about 250 centipoise (cP) to about 1000 cP. Suitable viscosity reducing additives include gasoline, naphtha, butanol, petroleum ether, diesel fuel, citrus oil based cleansers and degreasers, and mixtures thereof.

Also, U.S. Patent Application Number 20030132139, which is incorporated herein by reference, teaches decreasing the viscosity of crude oils and residuum by utilizing a combination of acid and sonic treatment. Each one alone does not substantially decrease viscosity and only when energy, in this case in the form of sonic energy is used in combination with an acid will a substantial decrease in viscosity result.

While there is much art in reducing viscosity to enhance the flow properties of crude oils it has generally been overlooked that crude oils are also viscoelastic fluids and thus, many of the heavy crude oils, those with high viscosities, also have relatively high elasticity. The high elasticity heavy oils have adverse impact on flow and particularly during injection of the heavy oil in process vessels. The most commonly employed technology for upgrading heavy oil is coking. Viscoelastic oils present unique challenges in feed injection to cokers due to the formation of so-called "necks" or filaments during feed injection. Improvements in feed injection by elimination of filaments or necks can improve heavy oil coking efficiency. Therefore, there remains a need in the art to treat a crude oil with a reagent that can desirably affect the elastic properties of crude oils.

SUMMARY OF THE INVENTION

In accordance with the present invention there is provided a method for upgrading a heavy oil by lowering its elastic modulus, thereby improving the flow properties of a heavy oil, which method comprises:

treating the feedstock with an effective amount of an elastic modulus lowering agent selected from the group consisting of organic and inorganic acids and bases, and metallo-porphyrins.

In a preferred embodiment, the elastic modulus lowering agent is a mixture of acids or a mixture of one or more acids and one or more metallo-porphyrins.

In another preferred embodiment, the elastic modulus lowering agent is a mixture of bases or a mixture of one or more bases with one or more metallo-porphyrins, metal naphthanates, metal acetylacetonates, metal carboxylates, and one and two ring metal phenates.

In a preferred embodiment, the elastic modulus lowering agent is a mineral acid selected from the group consisting of sulfuric acid, hydrochloric acid and perchloric acid.

In another preferred embodiment, the elastic modulus lowering agent is an organic acid selected from the group consisting of acetic, para-toluene sulfonic, alkyl toluene sulfonic acids, mono di- and trialkyl phosphoric acids, organic mono or di carboxylic acids, formic, $C_3$ to $C_{16}$ organic carboxylic acids, succinic acid, and low molecular weight petroleum naphthenic acid.

In yet another preferred embodiment of the present invention the elastic modulus lowering agent is a base selected from alkali or alkaline earth hydroxides, preferably selected from sodium hydroxide and potassium hydroxide.

In still another preferred embodiment of the present invention the elastic modulus lowering agent is a metallo-porphyrin.

In another preferred embodiment the feedstock is a vacuum residuum.

In still another preferred embodiment there is provided a method to improve injection of a heavy oil by treating said heavy oil with one or more elastic modulus lowering agents as mentioned above.

In yet another preferred embodiment there is provided a method for improved flow of viscoelastic fluids by treating the viscoelastic fluid with one or more elastic modulus lowering agents as mentioned above.

In another preferred embodiment the elastic modulus lowering agent is introduced into the heavy oil feed along with an effective amount of steam.

DETAILED DESCRIPTION OF THE INVENTION

Figure 1:
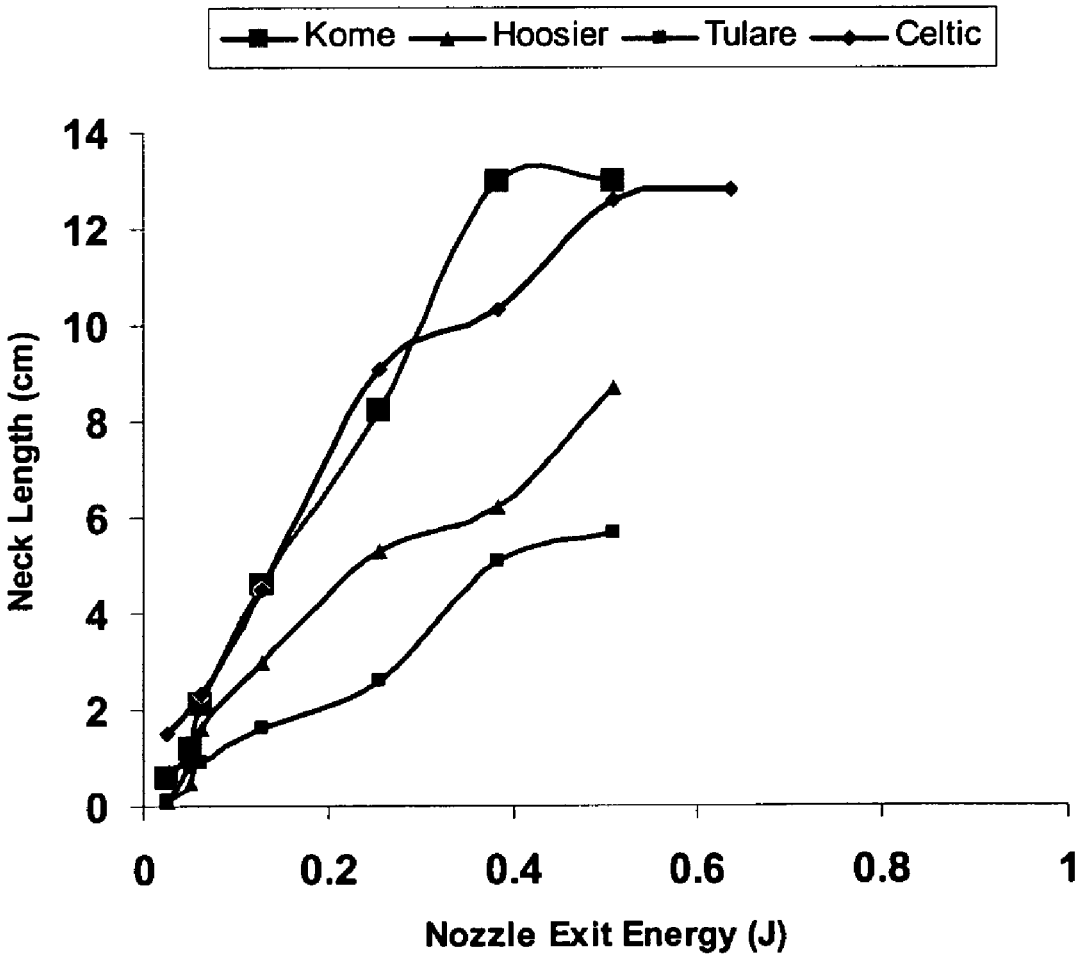
FIG. 1 hereof is a "neck" length versus nozzle exit energy plots for four representative heavy crude oils, Kome, Hoosier, Tulare and Celtic.

The present invention relates to the use of various chemical agents to lower the elastic modulus of a heavy petroleum oils, including petroleum crudes as well as their respective residua. Heavy petroleum oil feedstocks that can be treated in accordance with the present invention are those that have a high viscous modulus and a high elastic modulus. Crudes from different geographic sources differ with respect to their elastic modulus and viscous modulus. For example Maya crude from Mexico and Talco crude from the U.S. have an elastic modulus of about 0.090 Pa or less at about 45° C., while Hamaca crude from Venezuela has an elastic modulus greater than about 5 Pa (Pascal) at the same temperature. The elastic modulus for crudes will typically range from about 3.3 to about 54 Pa and for resides it will typically range from about 33 to about 540 Pa. The elastic modulus can be determined by oscillatory visometric measurements that are known to those of ordinary skill in the art. The term "heavy oils" as used herein refers to hydrocarbon oils having an API Gravity of less than about 20 and includes both petroleum crude oils as well as resids obtained from the atmospheric and vacuum distillation of such crudes.

It will be understood that the present invention can be practiced on various types of viscoelastic fluids, preferably heavy oil. For example, if the heavy oil is a crude oil in an underground reservoir an effective amount of elastic modulus lowering agent can be pumped into the reservoir to reduce the flow characteristic of the crude so that it will more easily flow through the formation pores and into the wellbore and brought to the surface. The elastic modulus lowering agent can also be applied to the heavy oil at a surface facility thereby reducing the elasticity of the oil so that it can be more easily transported via pipeline. The elastic modulus lowering agent can also be delivered with use of a carrier fluid, such as steam, a light oil, or distillate.

The elastic modulus lowering agents can also be added to resids that are sent to a delayed coker. The modulus lowering agents are preferably added to the resid sent to the delayed coker by use of feed injection. There are generally three different types of solid delayed coker products that have different values, appearances and properties, i.e., needle coke, sponge coke, and shot coke. Needle coke is the highest quality of the three varieties. Needle coke, upon further thermal treatment, has high electrical conductivity (and a low coefficient of thermal expansion) and is used in electric arc steel production. It is relatively low in sulfur and metals and is frequently produced from some of the higher quality coker feedstocks that include more aromatic feedstocks such as slurry and decant oils from catalytic crackers and thermal cracking tars. Typically, it is not formed by delayed coking of resid feeds.

Sponge coke, a lower quality coke, is most often formed in refineries. Low quality refinery coker feedstocks having significant amounts of asphaltenes, heteroatoms and metals produce this lower quality coke. If the sulfur and metals content is low enough, sponge coke can be used for the manufacture of electrodes for the aluminum industry. If the sulfur and metals content is too high, then the coke can be used as fuel. The name "sponge coke" comes from its porous, sponge-like appearance. Conventional delayed coking processes, using the preferred vacuum resid feedstock of the present invention, will typically produce sponge coke, which is produced as an agglomerated mass that needs an extensive removal process including drilling and water-jet technology. As discussed, this considerably complicates the process by increasing the cycle time.

Use of the elastic modulus lowering agents of the present invention, when used with resids in delayed coking are capable of producing a greater quantity of shot coke, preferably substantially free-flowing shot coke. While shot coke is one of the lowest quality cokes made in delayed coking, it is favored, especially when substantially free-flowing because it substantially reduces the time needed to empty the coke from the coker drum. The addition of an elastic modulus lowering agent of the present invention improves the injection of the resid into the coker furnace and thus so-called "long-necks" are substantially reduced and in some cases eliminated.

The amount of elastic modulus lowering agent used in the practice of the present invention will have a relatively wide range depending on the particular viscoelastic fluid, the particular agent used, and the conditions under which it is used. Typically, the amount used will range from about 0.01 to about 10 wt. %, preferably from about 0.1 to 5 wt. %, and more preferably from about 0.1 to 1 wt. %. The wt. % is based on the weight of the viscoelastic fluid.

The temperature at which the elastic modulus lowering agent is used is an effective temperature that will promote effective contacting of the agent with the viscoelastic fluid. The temperature will typically range from about 10° C. to a temperature up to, but not including, a temperature at which thermal cracking will occur, about 370° C.

In yet another embodiment, the elastic modulus lowering agent can be used to treat a resid prior to coking so that it has improved feed injection.

Non-limiting examples of elastic modulus lowering agents that can be used in the practice of the present invention include acids, bases, and phorphyrins. The acid can be a mineral acid or an organic acid. If a mineral acid the preferred acid is selected from sulfuric acid, hydrochloric acid and perchloric acid, with sulfuric acid and hydrochloric acid being more preferred. Although nitric acid will also lower the elastic modulus of heavy petroleum oils, it should be avoided because it could possible form an explosive mixture. Non-limiting examples of organic acids that can be used in the practice of the present invention include para-toluene sulfonic, alkyl toluene sulfonic acids, mono di- and trialkyl phosphoric acids, organic mono or di carboxylic acids, formic, $C_3$ to $C_{16}$ organic carboxylic acids, succinic acid, and low molecular weight petroleum naphthenic acid. Preferred organic acids include p-toluene sulfonic acid. Acetic acid is the more preferred. Crude oil high in naphthenic acid content (TAN) can be used as the source of petroleum naphthenic acids. Mixtures of mineral acids, mixtures of organic acids or combinations of mineral and organic acids may be used to produce the same effect. As used herein, crude oil residuum is defined as residual crude oil obtained from atmospheric or vacuum distillation.

If a base is used as the elastic modulus lowering agent it is preferred that the base be a hydroxide of an alkali metal, preferably sodium or potassium, such s sodium and potassium carbonate, or a an alkaline-earth metal analog thereof, preferably calcium and magnesium. More preferred are sodium hydroxide and potassium hydroxide.

Metallo-porphyrins are also suitable as elastic modulus lowering agents in the present invention. Non-limiting examples of metal-porphyrins suitable for use herein include those of a metal selected from the group consisting of vanadium, nickel, chromium, manganese, iron, cobalt, copper, and zinc. Vanadium and nickel are preferred and vanadium is more preferred.

The present can be better understood by reference to the following examples that are for illustrative purposes only.

EXAMPLES

Examples 1-4

The influence of asphaltenes, naphthenic acids and basic nitrogen on heavy oil viscoelasticity was tested by generating a set of heavy oil experiments using Hamaca crude oil. In example 1, Hamaca crude was solvent deasphalted using n-heptane. The resulting deasphalted crude is designated HAMACA-ASPH. In example 4, asphaltenes were added back to the deasphalted produce of example 1 and is designated HAMACA DAO+ASPH. In example 2 naphthenic acids were removed from the crude and is designated HAMACA-NAP ACID. In example 3, the product of example 2 was deasphalted with n-heptane and is designated HAMACA-NAP ACID-ASPH. The elastic modulus and viscous modulus was measured for all samples and the results are presented below in Table I.

TABLE I

| Example | Sample | Elastic Modulus G' (Pa) | Viscous Modulus G" (Pa) |
|---|---|---|---|
| | HAMACA Crude | 3.33 | 54.69 |
| 1 | HAMACA-ASPH | 0.72 | 7.62 |
| 2 | HAMACA-TAN | 0.54 | 11.15 |
| 3 | HAMACA-TAN-ASPH | 0.17 | 2.07 |
| 4 | HAMACA DAO + ASPH | 2.94 | 29.05 |

The above data evidences that the elastic modulus can be lowered by removing asphaltenes and naphthenic acids in a heavy oil.

Examples 5-12

In the following examples, three Cold Lake crude oil samples (a, b, and c) were treated with sodium hydroxide, sulfuric acid, and para-toluene sulfonic acid in the concentrations shown in Table II below. The elastic modulus (G') and viscous modulus (G") were measured for each sample by use of a viscometer in an oscillatory mode of operation. The results are presented in Table II below.

TABLE II

| Source of Crude | Example | Elastic Modulus Lowering Agent | Temperature of Run ° C. | Elastic Modulus G' (Pa) | Viscous Modulus G" (Pa) |
|---|---|---|---|---|---|
| a | 5 | None | 40 | 2.84 | 40.10 |
| a | 6 | 1% aq. NaOH | 40 | 1.26 | 40.78 |
| a | 7 | None | 60 | 0.69 | 8.52 |
| a | 8 | 1% aq. $H_2SO_4$ | 60 | 0.31 | 14.80 |
| b | 9 | None | 45 | 3.64 | 51.37 |
| b | 10 | 1% p-toluene sulfonic acid | 45 | 2.00 | 51.30 |
| c | 11 | None | 60 | 2.70 | 27.06 |
| c | 12 | 0.1% Vanadyl porphyrin | 60 | 1.48 | 12.90 |

The data in the above table evidences the unexpected nature of the present invention in that asphaltenes and naphthenic acids do not have to be removed from a heavy oil in order to lower its' elastic modulus. This is contrary to the teachings in the art, as shown in Table I above, that the elastic modulus can only be lowered by removing asphaltenes and naphthenic acids. The above table shows that the use of an elastic modulus lowering agent of the present invention can lower the elastic modulus without removing asphaltenes and naphthenic acids. It also shows that it is also possible to use an elastic modulus lowering agent that is selective for lowering the elastic modulus without substantially changing the viscous modulus. For example, the use of agents of the present invention reduced the elastic modulus of the heavy oil with the viscous modulus being substantially unchanged as in examples 6 and 10. In example 8, the elastic modulus was substantially lowered wherein the viscous modulus was substantially increased.

Examples 13-17

A suite of heavy oils shown in Table III below were subjected to a feed injection experiment. The feed injection set up involved a positive displacement pump that pumped the heavy oil through a needle having an orifice of 0.25 cm in diameter. The needle was placed in a cylindrical glass tube filled with water and the resid flow rate through the orifice varied. The cylindrical glass tube was videotaped to record the flow behavior of the heavy oil as it emerged through the orifice.

Figure 2:
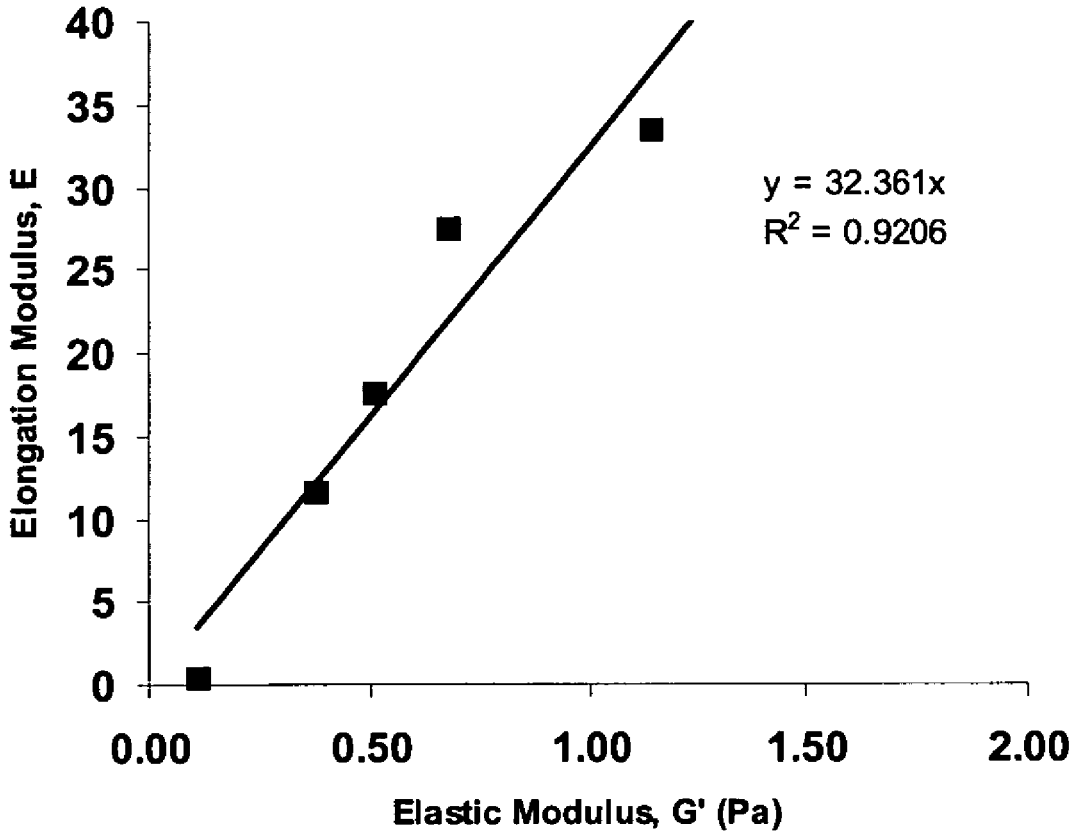
FIG. 2 hereof is a correlation plot of elongation modulus versus elastic modulus for five representative heavy crude oils of Examples 13-17 hereof.
Figure 3:
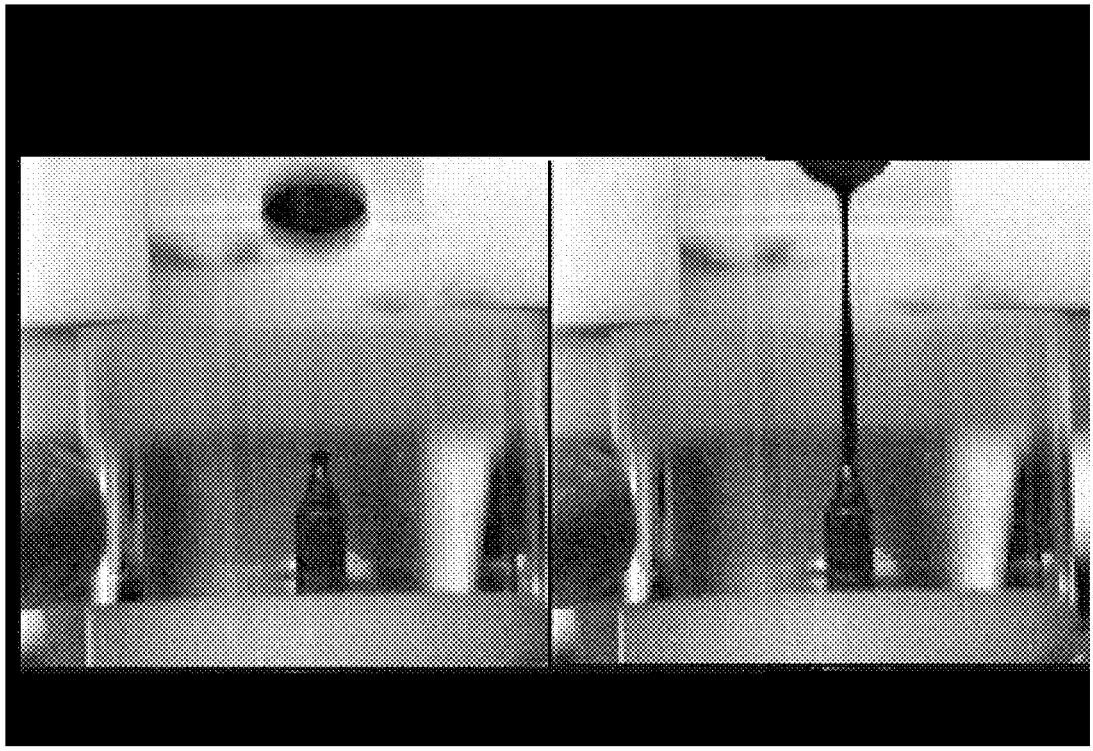
FIG. 3 shows side-by-side comparison photographs evidencing the unexpected results obtained by reduction of elasticity when an elastic modulus lowering agent is added to a heavy crude oil (left hand side frame) versus the untreated heavy crude oil (right hand side frame).

A representative frame for the Cold Lake crude oil is shown in FIG. 3 hereof. A long "neck" is observed for the heavy oil as it emerges from the orifice as seen in the right hand side frame of FIG. 3 hereof. The observed "necking" phenomenon is due to the high elastic modulus of the viscoelastic oil. The neck length varied as a function of flow rate or nozzle exit energy. Neck length versus nozzle exit energy plots for four representative heavy oils are shown in FIG. 1 hereof. An elongation modulus (E) was calculated from the slope of the individual plots and calculated values are shown in Table III hereof. The elongation modulus (E) correlated well with the elastic modulus (G') determined by oscillatory viscometry and are shown in the correlation plot of FIG. 2 hereof.

The correlation suggests that a reduction in the elastic modulus will reduce "necking". Thus, the practice of the present invention can also improve the feed injection of heavy oil to a coker by treating the heavy oil to reduce the elastic modulus prior to injection through the distributor plates of a coker furnace. Indeed, as observed in FIG. 3, left hand side frame, when cold lake crude oil was treated with an elastic modulus reducing agent (1 wt % sulfuric acid), we observe the complete disappearance of the neck.

TABLE-III

| EXAMPLE | CRUDE OIL | SLOPE (E) |
|---|---|---|
| 13 | Maya (Mexico) | 0.49 |
| 14 | Talco (USA) | 0.52 |
| 15 | Hoosier (Canada) | 17.6 |
| 16 | Kome (Chad) | 33.5 |
| 17 | Tulare (USA) | 11.8 |

The invention claimed is:

1. A method for improving the flow properties of a heavy oil feedstock by lowering its elastic modulus, which method comprises:

treating the feedstock with an effective amount of an elastic modulus lowering agent selected from porphyrins.

2. The method of claim 1 wherein the elastic modulus lowering agent is a metallo-porphyrin selected from nickel and vanadium porphyrin.

3. The method of claim 1 wherein the elastic modulus lowering agent is used in combination with an effective amount of steam.

4. A delayed coking process comprising:

a) heating a petroleum resid, which is essentially a solid at room temperature, in a first heating zone, to a temperature below coking temperatures wherein it is convened to a pumpable liquid;

b) conducting said heated resid to a second heating zone wherein it is heated to an effective coking temperature;

c) conducting said heated resid from said second heating zone to a coking zone wherein vapor products are collected overhead and coke is formed;

d) introducing into said resid at least one elastic modulus lowering agent selected from porphyrins, wherein said at least one elastic modulus lowering agent is introduced into said vacuum resid at a point upstream of the first heating zone, upstream of the second heating zone, or both.

5. The method of claim 4 wherein the elastic modulus lowering agent is a metallo-porphyrin selected from nickel and vanadium porphyrin.

6. The method of claim 4 wherein the elastic modulus lowering agent is used in combination with an effective amount of steam.

7. A method for improving the flow of a petroleum crude oil in a subterranean environment, which method comprises introducing into said subterranean environment an effective amount of an elastic modulus lowering agent selected from porphyrins that is effective for lowering the elastic modulus of the petroleum crude.

8. The method of claim 7 wherein said elastic modulus lowering agent is introduced into said subterranean environment in a carrier fluid.

9. The method of clam 8 wherein the cater fluid is selected from light oils and distillates.

10. The method of claim 7 wherein said elastic modulus lowering agent is a metallo-porphyrin selected from nickel and vanadium porphyrin.

* * * * *